US012313385B2

(12) United States Patent
Reed

(10) Patent No.: US 12,313,385 B2
(45) Date of Patent: May 27, 2025

(54) CRIMPING DIE

(71) Applicant: Jesse Reed, Redford, NY (US)

(72) Inventor: Jesse Reed, Redford, NY (US)

( * ) Notice: Subject to any disclaimer, the term of this patent is extended or adjusted under 35 U.S.C. 154(b) by 0 days.

(21) Appl. No.: 18/435,318

(22) Filed: Feb. 7, 2024

(65) Prior Publication Data

US 2024/0263929 A1 Aug. 8, 2024

Related U.S. Application Data

(60) Provisional application No. 63/483,581, filed on Feb. 7, 2023.

(51) Int. Cl.
*F42B 33/00* (2006.01)

(52) U.S. Cl.
CPC ..... *F42B 33/005* (2013.01)

(58) Field of Classification Search
CPC ..... F42B 33/005
See application file for complete search history.

(56) References Cited

U.S. PATENT DOCUMENTS 605,338 A * 6/1898 Place ..... F42B 33/001 86/12
2,133,198 A * 10/1938 Jayne ..... 86/24
2,571,272 A * 10/1951 Martin ..... F42B 33/10 86/24
2,700,915 A * 2/1955 Pattison ..... F42B 33/001 86/39
2,719,453 A * 10/1955 Bahler ..... F42B 33/005 86/43
3,048,077 A * 8/1962 Shelton ..... F42B 33/12 86/40
3,440,923 A * 4/1969 Purdie ..... F42B 33/10 86/43
4,723,472 A * 2/1988 Lee ..... F42B 33/10 86/24
4,862,567 A * 9/1989 Beebe ..... F42B 33/005 86/43
5,079,986 A 1/1992 Lee
5,649,465 A * 7/1997 Beebe ..... F42B 33/10 86/24
6,244,154 B1 * 6/2001 Beebe ..... F42B 33/005 86/24
7,650,825 B1 * 1/2010 Lee ..... B23B 5/168 86/24
7,681,481 B1 3/2010 Buckley
7,703,369 B1 * 4/2010 Lee ..... F42B 33/10 86/43

(Continued)

*Primary Examiner* — Derrick R Morgan
(74) *Attorney, Agent, or Firm* — Downs Rachlin Martin PLLC

(57) ABSTRACT

A crimping die assembly for crimping a cartridge is provided that includes a casing and a bullet seated in the casing. The crimping die assembly includes a die body with a longitudinal axis, an elongated cavity disposed along the longitudinal axis, a cartridge receiver opening for receiving the cartridge, disposed at a first end of the die body, and opening into to the elongated cavity, a crimping bushing for crimping the casing onto the bullet, disposed within the elongated cavity and translatable therein along the longitudinal axis, and a compliant member disposed at least partially within the elongated cavity for urging the crimping bushing toward the cartridge receiver opening.

11 Claims, 4 Drawing Sheets

(56) References Cited

U.S. PATENT DOCUMENTS

| | | | | |
|---|---|---|---|---|
| 7,854,188 | B1 * | 12/2010 | Buckley | F42B 33/005 86/39 |
| 8,689,668 | B1 * | 4/2014 | Rider | F42B 33/005 83/41 |
| 10,655,944 | B1 * | 5/2020 | Gent | F42B 33/002 |
| 11,326,864 | B1 * | 5/2022 | McPherson | F42B 33/005 |
| 11,719,521 | B2 * | 8/2023 | Burke | F42B 33/005 86/41 |
| 2016/0040969 | A1 * | 2/2016 | Kleinschmit | F42B 33/001 86/43 |
| 2024/0263929 | A1 * | 8/2024 | Reed | F42B 33/005 |
| 2024/0263930 | A1 * | 8/2024 | Reed | F42B 33/005 |

* cited by examiner

CRIMPING DIE

FIELD OF THE INVENTION

The present invention generally relates to ammunition preparation tools, and more specifically to an ammunition crimping die.

BACKGROUND

Reloading spent ammunition cases requires removing and replacing the spent primer cap and shaping of the mouth end and the body portion of the case. The case is then filled with powder and a bullet is inserted in the open end. The neck is then crimped to secure the bullet, such as a roll crimp. The mouth of the case is rolled into the bullet crimping groove by pushing the case against an angled shoulder in a seating die. As the ammunition case with a bullet is forced into the die, the bullet engages a stop that pushes the bullet into the case to a depth and, when it reaches the appropriate depth, the edge of the mouth of the case reaches a tapered shoulder that rolls the edge of the mouth into the bullet.

A uniform and firm crimp is desirable for ammunition since if the crimp is not firm, the bullet may become misaligned or loosened, resulting in the start or initial pressure generated by ignition of the powder in the case may not be as uniform as desirable. Crimp dies generally require the case lengths to be uniform to secure a uniform crimp. Further, if the crimp die is incorrectly adjusted, excessive force on the case mouth can damage the case behind the crimp.

SUMMARY OF THE DISCLOSURE

A crimping die assembly for crimping a cartridge is provided that includes a casing and a bullet seated in the casing. The crimping die assembly includes a die body with a longitudinal axis, an elongated cavity disposed along the longitudinal axis, a cartridge receiver opening for receiving the cartridge, disposed at a first end of the die body, and opening into to the elongated cavity, a crimping bushing for crimping the casing onto the bullet, disposed within the elongated cavity and translatable therein along the longitudinal axis, and a compliant member disposed at least partially within the elongated cavity for urging the crimping bushing toward the cartridge receiver opening.

BRIEF DESCRIPTION OF THE DRAWINGS

For the purpose of illustrating the disclosure, the drawings show aspects of one or more embodiments of the disclosure. However, it should be understood that the present disclosure is not limited to the precise arrangements and instrumentalities shown in the drawings, wherein.

DETAILED DESCRIPTION

The crimping die of the present invention includes a spring that controls the crimp. The spring is included on top of the sleeve. A cap is included to adjust the spring tension and a hole in the crimp sleeve is for receiving the bullet. As the loaded cartridge is pushed into the die, the spring loaded sleeve crimps the bullet with the same tension (of the spring) even if the cases are not the same length. Thus, the tension of the crimp is the same.

Figure 1:
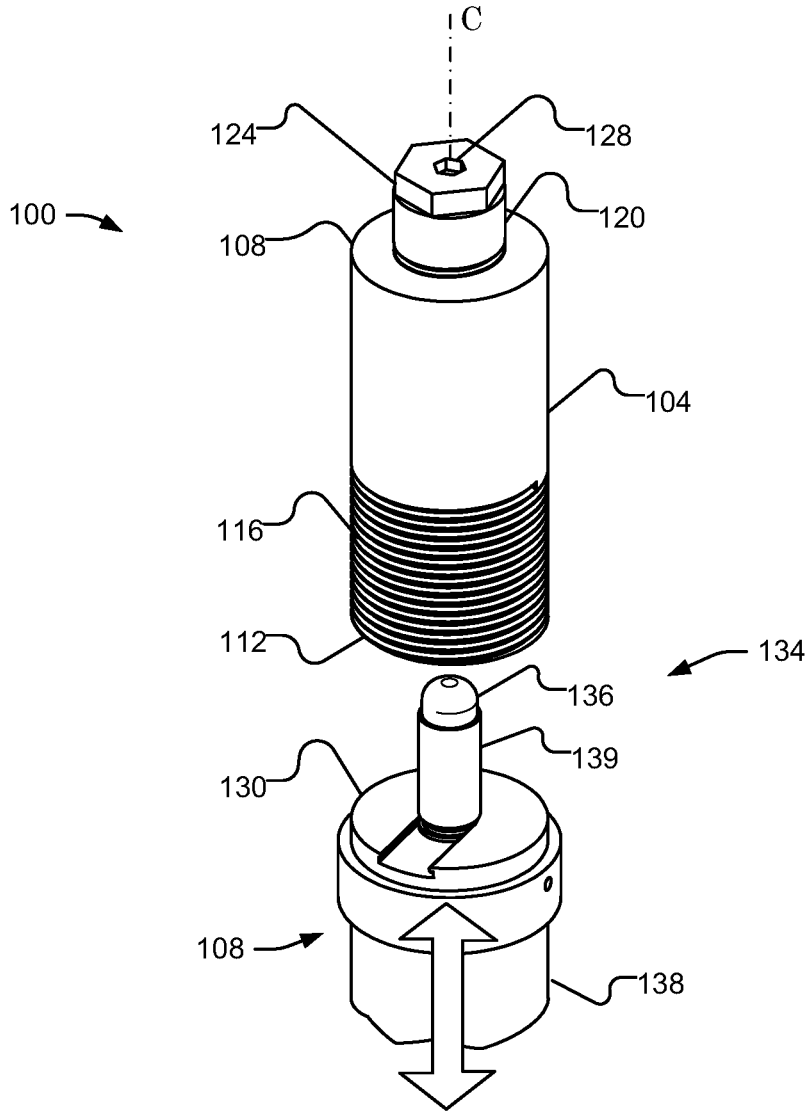
FIG. 1 is a perspective view of a crimping die in accordance with an embodiment of the present invention.

FIG. 1 is a perspective view of a crimping die assembly 100 that includes a die body 104. FIG. 1 also includes a cartridge holder assembly 108. The die body 104 includes a first end 108 and a second end 112, with thread mounts 116 to mount the die on a press. An adjustment cap 120 may include a hex nut 124, receiver 128 for an Allen wrench. The cartridge holder assembly includes a cartridge holder 130 for supporting a cartridge 134 with a bullet 136 and casing 139, and a plunger 138 that is moved up and down by the press to engage with the die body 104.

Figure 2:
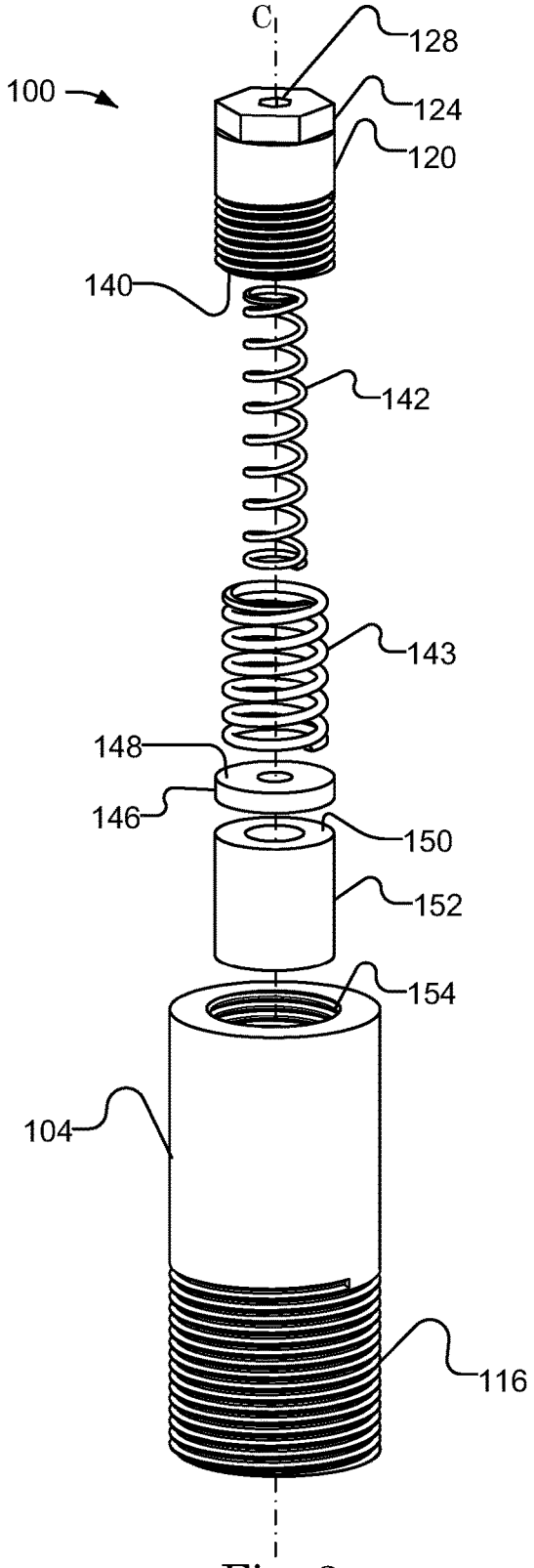
FIG. 2 is an exploded view of a portion of the crimping die of FIG. 1.

FIG. 2 shows an exploded view of the die body 104 along a longitudinal axis (C). The adjustment cap 120 includes a third seating surface 140 at the proximal end of the cap. A first biasing element 142 and a second biasing element 143 are disposed between the adjustment cap 120 and a spacer 146, wherein the spacer includes a first seating surface 148. The spacer 146 is configured to engage with a top surface 150 of a crimping bushing 152. The die body includes a receiver 154 for receiving the adjustment cap 120. The adjustment cap 120 includes one or both of a hex nut interface 124 (machined or via a nut threaded onto the cap) and an Allen wrench interface 128 for tightening and loosening the adjustment cap 120.

Figure 3A:
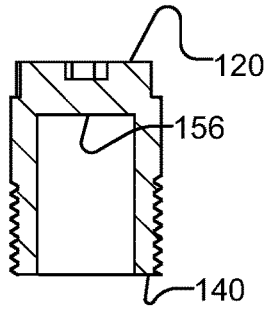
FIG. 3A is a cross view of an adjustment cap of the crimping die of FIG. 1.
Figure 3B:
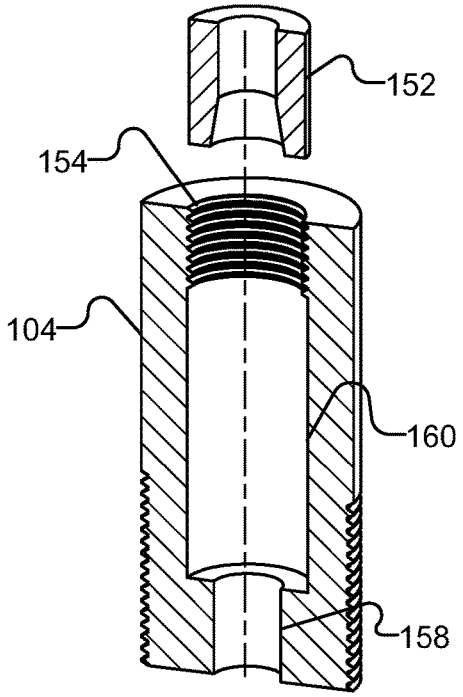
FIG. 3B is a cross view of a die body of the crimping die of FIG. 1.

FIG. 3A is a cross view of the adjustment cap 120, in which a second seating surface 156 can be seen. FIG. 3B is a cross view of the die body 104 and crimping bushing 152. The die body 104 includes a cartridge receiver 158 and a bushing cavity 160. The crimping bushing 152 and spacer 146 are assembled into the bushing cavity 160 of the crimping die body 104. The spacer 146 includes the first seating surface 148 for seating biasing elements 142, 143. In some embodiments, the spacer 146 may be optional in which case a top surface 150 of the crimping bushing 152 serves and the first seating surface. The first biasing element 142 and second biasing element 143 are assembled into the bushing cavity 160 of the seating die 104 and the cap 120 is assembled into the adjustment cap receiver 154.

The first biasing element 142 is disposed between the first seating surface 148 of the spacer 146 and the second seating surface 156 of the cap 120. The second biasing element 143 is disposed between the first seating surface 148 of the spacer 146 and the third seating surface 140 of the cap 120. The seating die can be used with only one of the first and second biasing elements, depending on the desired biasing force, which may also be adjusted by changing the force of the biasing element(s), for example by selecting between springs having different spring constants.

Figure 4B:
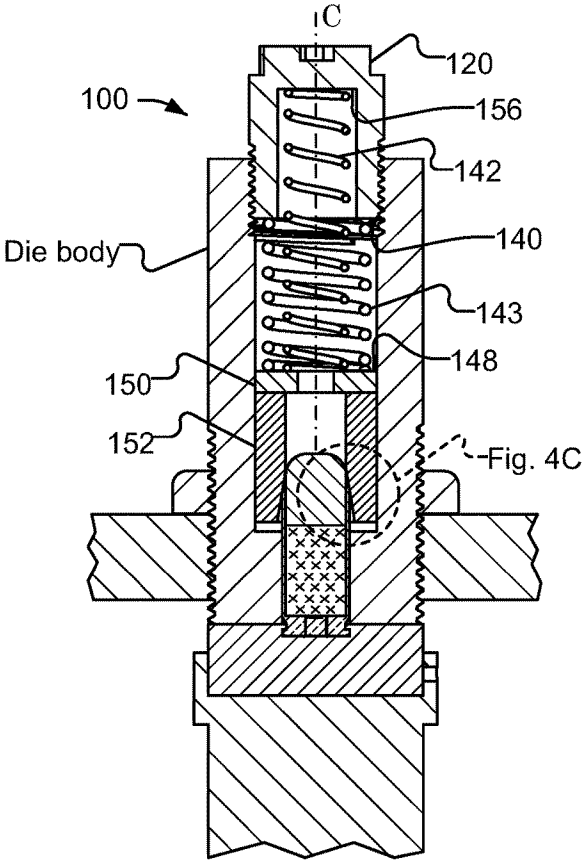
FIGS. 4A-4B are cross views of the crimping die body at different stages of the crimping process.
Figure 4A:
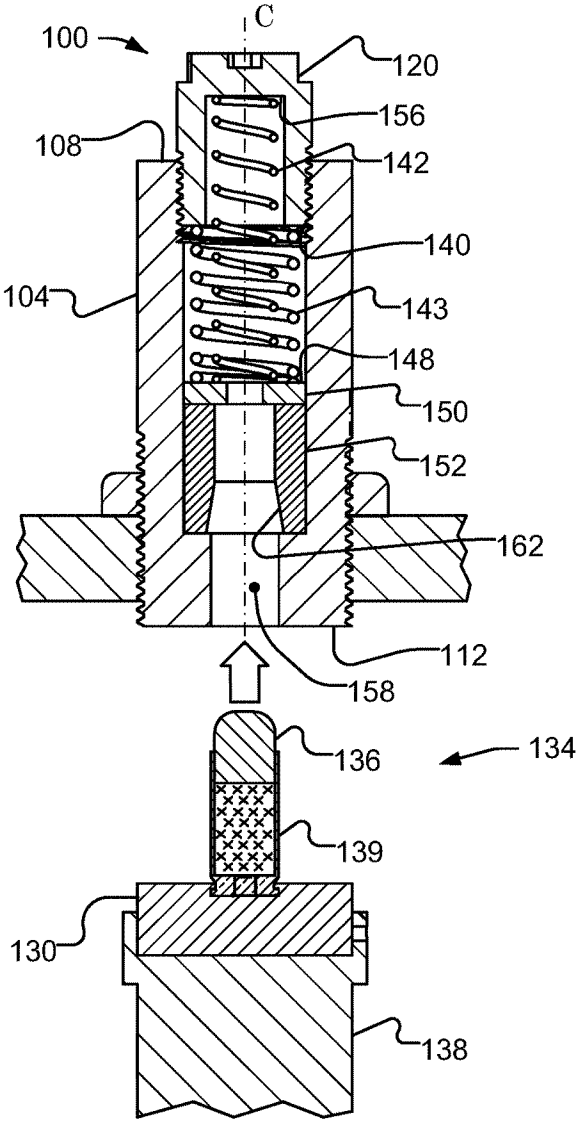
Figure 4C:
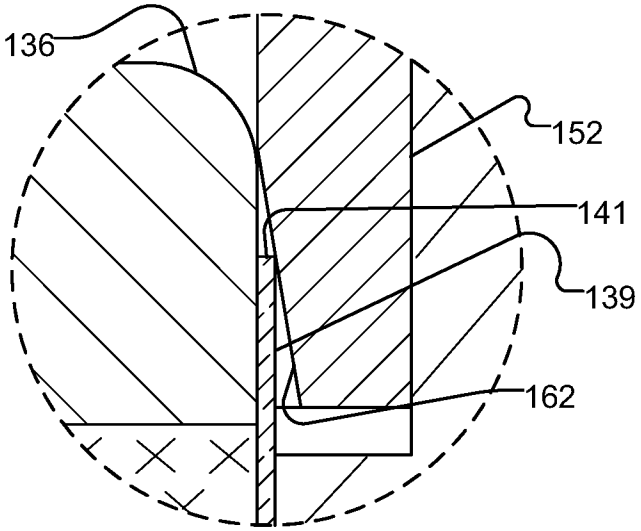
FIG. 4C is a detail view of a portion of FIG. 4B.

Turning to FIGS. 4A-4C, a cartridge 134 with a bullet 136 seated in a casing 139 at a correct depth is loaded on the cartridge holder assembly 108. The press is operated to push the cartridge 134 into the crimping die 100, in particular into the cartridge receiver 158 of the die body 104. A top edge 141 of the casing 139 impinges on the crimping taper 162 of the crimping bushing 152 (which can be seen in FIG. 4C). The crimping bushing 152 tends to be pushed upward, i.e., towards the second end 108 of the die body 104, by the upward movement of the cartridge 134 but the biasing elements 142, 143 resist the motion so that the crimping taper 162 pushes a top portion of the casing 139 into the bullet 136, thereby crimping the cartridge 134. The crimping bushing 152 is able to translate along the longitudinal axis C while the biasing element(s) 142, 143 impart a force capable of crimping the cartridge 134. This allows the crimping die 100 to work for different cartridge lengths without the need for trimming. The crimping force can be adjusted, and the resultant crimp of the casing into the bullet, by adjusting the cap 120 and/or by swapping out the biasing elements 142 and/or 143 in varying numbers and/or lengths and spring force. Also, the cap 120 can be adjusted for different length cartridges/bullets.

Various modifications and additions can be made without departing from the spirit and scope of this invention. Features of each of the various embodiments described above may be combined with features of other described embodiments as appropriate in order to provide a multiplicity of feature combinations in associated new embodiments. Furthermore, while the foregoing describes a number of separate embodiments, what has been described herein is merely illustrative of the application of the principles of the present invention. Additionally, although particular methods herein may be illustrated and/or described as being performed in a specific order, the ordering is highly variable within ordinary skill to achieve aspects of the present disclosure. Accordingly, this description is meant to be taken only by way of example, and not to otherwise limit the scope of this invention.

What is claimed is:

1. A crimping die assembly for crimping a cartridge that includes a casing and a bullet seated in the casing, the crimping die assembly comprising:

a die body including:

a longitudinal axis;

an elongated cavity disposed along the longitudinal axis;

a cartridge receiver opening for receiving the cartridge, disposed at a first end of the die body, and opening into to the elongated cavity;

a crimping bushing for crimping the casing onto the bullet, disposed within the elongated cavity and translatable therein along the longitudinal axis;

a compliant member disposed at least partially within the elongated cavity for urging the crimping bushing toward the cartridge receiver opening;

wherein the compliant member includes a first compliant member and a second compliant member, wherein the first compliant member is disposed between a first seating surface and a second seating surface, wherein the second compliant member is disposed between the first seating surface and a third seating surface, and wherein the third seating surface is disposed between the second seating surface and the first seating surface; and wherein the crimping die assembly includes an adjustment cap disposed at a second end of the die body, the second end opposing the first end along the longitudinal axis, wherein the adjustment cap comprises the second seating surface and the third seating surface.

2. The crimping die assembly of claim 1, wherein the compliant member comprises a coil spring.

3. The crimping die assembly of claim 1, wherein the compliant member comprises a leaf spring.

4. The crimping die assembly of claim 1, wherein the compliant member is disposed between a first seating surface and a second seating surface and wherein the second seating surface is movable closer to or further away from the first seating surface to alter an amount of force the compliant member imparts on the crimping bushing.

5. The crimping die assembly of claim 4, wherein a spacer is disposed between the crimping bushing and the compliant member and wherein the first seating surface comprises a surface of the spacer.

6. The crimping die assembly of claim 4, wherein the crimping die assembly includes an adjustment cap disposed at a second end of the die body, the second end opposing the first end along the longitudinal axis and wherein the adjustment cap comprises the second seating surface.

7. The crimping die assembly of claim 6, wherein the adjustment cap is translatable along the longitudinal axis to increase or decrease a distance between the first seating surface and the second seating surface.

8. The crimping die assembly of claim 1, wherein the second and third seating surfaces are movable closer to and further away from the first seating surface to alter an amount of crimping force imparted on the crimping bushing.

9. The crimping die assembly of claim 1, wherein the adjustment cap is translatable along the longitudinal axis to increase or decrease a distance between the first seating surface and the second seating surface and between the first seating surface and the third seating surface.

10. The crimping die assembly of claim 1, wherein the crimping bushing comprises an opening disposed along the longitudinal axis comprising a crimping taper surface disposed at an acute angle relative to the longitudinal axis.

11. The crimping die assembly of claim 10, wherein the die body is mountable on a bullet loading press, the bullet loading press being operable to push the cartridge into the cartridge receiver opening, wherein, when the cartridge is pushed into the cartridge receiver opening, a top edge of the casing impinges on the crimping taper surface, thereby urging the crimping bushing towards a second end of the die body, and wherein the compliant member urges the crimping bushing towards the first end of the die body.

* * * * *